US007866596B2

(12) United States Patent
Yamada

(10) Patent No.: US 7,866,596 B2
(45) Date of Patent: Jan. 11, 2011

(54) RECORDING-PAPER-ROLL SUPPORTING DEVICE AND PRINTER

(75) Inventor: Masayuki Yamada, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/465,232

(22) Filed: May 13, 2009

(65) Prior Publication Data

US 2009/0283623 A1 Nov. 19, 2009

(30) Foreign Application Priority Data

May 14, 2008 (JP) ..... 2008-127011

(51) Int. Cl.
*B65H 75/18* (2006.01)

(52) U.S. Cl. ..... 242/596.7; 242/599.4

(58) Field of Classification Search ..... 242/596, 242/596.4, 596.7, 599, 599.3, 599.4
See application file for complete search history.

(56) References Cited

U.S. PATENT DOCUMENTS 5,322,234 A * 6/1994 Robert et al. ..... 242/596.7
6,092,758 A * 7/2000 Gemmell ..... 242/596.4
6,491,252 B2 * 12/2002 Komatsu et al. ..... 242/596.4
2003/0173451 A1 * 9/2003 Inana ..... 242/596.7
2004/0211853 A1 * 10/2004 Inana et al. ..... 242/596.4

FOREIGN PATENT DOCUMENTS

JP 1-137939 9/1989
JP 2006-188355 7/2006

* cited by examiner

*Primary Examiner*—William A Rivera
(74) *Attorney, Agent, or Firm*—SNR Denton US LLP

(57) ABSTRACT

A recording-paper-roll supporting device includes first and second members. The first member includes an insertion portion, a supporting portion at an end of the insertion portion, and a support shaft at an end of the supporting portion. The supporting portion includes an outer peripheral surface, insertion-portion-side cam surfaces at different phases and heights, a collar portion, support-shaft-side cam surfaces at different phases and heights, and a cut section. The second member includes a cylindrical portion, a flange portion, a cam follower, and an engaging claw. When the outer peripheral surface is inserted along the inner peripheral surface and the cam follower and the engaging claw are selectively engaged with the insertion-portion-side cam surfaces and the support-shaft-side cam surfaces, the engaging claw is elastically deformed and generates a reactive force which presses the cam follower so that the second member is positioned on the supporting portion.

8 Claims, 17 Drawing Sheets

RECORDING-PAPER-ROLL SUPPORTING DEVICE AND PRINTER

BACKGROUND OF THE INVENTION

1. Field of the Invention

The present invention relates to a recording-paper-roll supporting device which supports a recording paper roll obtained by winding a sheet of recording paper into a roll and a printer including the recording-paper-roll supporting device.

2. Description of the Related Art

Recently, printers using recording paper rolls, which are advantageous in increasing the image quality and reducing costs, have been provided.

In such a printer, recording paper is unwound from a recording paper roll that is rotatably supported by a recording-paper-roll supporting device, and an image is printed on the recording paper.

In many cases, the recording-paper-roll supporting device includes an insertion member inserted into a center hole of the recording paper roll at an end thereof, a flange member provided on the insertion member and is brought into contact with the end of the recording paper roll, that is, with an edge of the recording paper in the width direction thereof, and a support shaft provided at an end of the insertion member. The support shaft is rotatably supported by a bearing provided in the printer.

In general, a plurality of types of recording paper with different dimensions in the width direction are provided.

Accordingly, a recording-paper-roll supporting device has been proposed which is structured such that the position of the flange member can be adjusted in accordance with the dimension of the recording paper in the width direction (see Japanese Unexamined Patent Application Publication No. 2006-188355).

In addition, a recording-paper-roll supporting device has been proposed in which a position of a detachable adjuster can be changed in accordance with the dimension of the recording paper in the width direction (see Japanese Unexamined Utility Model Registration Application Publication No. 01-137939).

SUMMARY OF THE INVENTION

However, in the device of the related art in which the position of the flange member can be adjusted, the structure for adjusting the position of the flange member is complex and large, and it is necessary to provide a space for accommodating the structure. Therefore, it is difficult to reduce the size of the printer.

In addition, in the device of the related art including the adjuster, there is a risk that the adjuster will be lost and the device does not have high user friendliness.

In view of the above-described situation, it is desirable to provide a recording-paper-roll supporting device and a printer which are advantageous in simplifying the structure thereof and improving the user friendliness.

According to an embodiment of the present invention, there is provided a recording-paper-roll supporting device which includes a first member and a second member. The first member includes an insertion portion inserted into a center hole of a recording paper roll at an end of the recording paper roll, the recording paper roll being obtained by winding a sheet of recording paper into a roll, a supporting portion provided at an end of the insertion portion, and a support shaft provided at an end of the supporting portion. The supporting portion includes an outer peripheral surface which is coaxial with the insertion portion, a plurality of insertion-portion-side cam surfaces provided at an end of the outer peripheral surface that is adjacent to the insertion portion, the insertion-portion-side cam surfaces facing the outer peripheral surface in an annular area outside the outer peripheral surface in a radial direction and being disposed at different phases in a circumferential direction and at different heights in an axial direction, a collar portion provided at an end of the outer peripheral surface that is adjacent to the support shaft and having a diameter larger than a diameter of the outer peripheral surface at the end adjacent to the support shaft, a plurality of support-shaft-side cam surfaces provided at an end of the collar portion that is adjacent to the support shaft and being disposed at different phases in the circumferential direction and at different heights in the axial direction, and a cut section formed in an outer peripheral area of the collar portion. The second member includes a cylindrical portion having an inner peripheral surface along which the outer peripheral surface is inserted, a flange portion provided on the cylindrical portion, the flange portion being coaxial with the cylindrical portion and having a diameter larger than a diameter of the cylindrical portion, a cam follower provided at an end of the cylindrical portion in the axial direction, the cam follower being selectively engageable with the insertion-portion-side cam surfaces, and an engaging claw capable of being inserted through the cut section and being moved on the supporting portion, the engaging claw being selectively engageable with the support-shaft-side cam surfaces. In the state in which the outer peripheral surface is inserted along the inner peripheral surface so that the cylindrical portion is supported by the supporting portion, in which the cam follower is selectively engaged with the insertion-portion-side cam surfaces, and in which the engaging claw is selectively engaged with the support-shaft-side cam surfaces, the engaging claw is elastically deformed in the axial direction by the support-shaft-side cam surface that is engaged with the engaging claw and generates a reactive force which presses the cam follower against the insertion-portion-side cam surface that is engaged with the cam follower, so that the second member is positioned on the supporting portion in the axial direction.

According to another embodiment of the present invention, there is provided a recording-paper-roll supporting device which includes a third member, a fourth member, and a coil spring. The third member includes an insertion portion inserted into a center hole of a recording paper roll at an end of the recording paper roll, the recording paper roll being obtained by winding a sheet of recording paper into a roll, and a flange portion provided at an end of the insertion portion, the flange portion being coaxial with the insertion portion and having a diameter larger than a diameter of the insertion portion. The fourth member includes a support shaft, and a plurality of engaging claws provided at an end of the support shaft, the engaging claws being disposed in the insertion portion and engaged with cut sections in the insertion portion while compressing the coil spring. The support shaft is biased by the coil spring to a projecting position at which the engaging claws engage with the cut sections, and is capable of being pushed inward toward the insertion portion of the support shaft.

According to another embodiment of the present invention, there is provided a printer which includes a recording-paper-roll supporting device including a first member and a second member. The first member includes an insertion portion inserted into a center hole of a recording paper roll at an end of the recording paper roll, the recording paper roll being obtained by winding a sheet of recording paper into a roll, a supporting portion provided at an end of the insertion portion, and a support shaft provided at an end of the supporting portion. The supporting portion includes an outer peripheral surface which is coaxial with the insertion portion, a plurality of insertion-portion-side cam surfaces provided at an end of the outer peripheral surface that is adjacent to the insertion portion, the insertion-portion-side cam surfaces facing the outer peripheral surface in an annular area outside the outer peripheral surface in a radial direction and being disposed at different phases in a circumferential direction and at different heights in an axial direction, a collar portion provided at an end of the outer peripheral surface that is adjacent to the support shaft and having a diameter larger than a diameter of the outer peripheral surface at the end adjacent to the support shaft, a plurality of support-shaft-side cam surfaces provided at an end of the collar portion that is adjacent to the support shaft and being disposed at different phases in the circumferential direction and at different heights in the axial direction, and a cut section formed in an outer peripheral area of the collar portion. The second member includes a cylindrical portion having an inner peripheral surface along which the outer peripheral surface is inserted, a flange portion provided on the cylindrical portion, the flange portion being coaxial with the cylindrical portion and having a diameter larger than a diameter of the cylindrical portion, a cam follower provided at an end of the cylindrical portion in the axial direction, the cam follower being selectively engageable with the insertion-portion-side cam surfaces, and an engaging claw capable of being inserted through the cut section and being moved on the supporting portion, the engaging claw being selectively engageable with the support-shaft-side cam surfaces. In the state in which the outer peripheral surface is inserted along the inner peripheral surface so that the cylindrical portion is supported by the supporting portion, in which the cam follower is selectively engaged with the insertion-portion-side cam surfaces, and in which the engaging claw is selectively engaged with the support-shaft-side cam surfaces, the engaging claw is elastically deformed in the axial direction by the support-shaft-side cam surface that is engaged with the engaging claw and generates a reactive force which presses the cam follower against the insertion-portion-side cam surface that is engaged with the cam follower, so that the second member is positioned on the supporting portion in the axial direction.

According to another embodiment of the present invention, there is provided a printer which includes a third member, a fourth member, and a coil spring. The third member includes an insertion portion inserted into a center hole of a recording paper roll at an end of the recording paper roll, the recording paper roll being obtained by winding a sheet of recording paper into a roll, and a flange portion provided at an end of the insertion portion, the flange portion being coaxial with the insertion portion and having a diameter larger than a diameter of the insertion portion. The fourth member includes a support shaft, and a plurality of engaging claws provided at an end of the support shaft, the engaging claws being disposed in the insertion portion and engaged with cut sections in the insertion portion while compressing the coil spring. The support shaft is biased by the coil spring to a projecting position at which the engaging claws engage with the cut sections, and is capable of being pushed inward toward the insertion portion of the support shaft.

According to the embodiments of the present embodiment, a simple structure is provided in which the cam follower is selectively engaged with the insertion-portion-side cam surfaces and the engaging claw is selectively engaged with the support-shaft-side cam surfaces. The flange portion can be positioned relative to the support shaft in the axial direction with such a simple structure.

In addition, according to the embodiments of the present invention, the support shaft of the fourth member is constantly biased to the projecting position and is capable of being pushed inward toward the insertion portion. Therefore, if the recording-paper-roll supporting device including the third and fourth members is used together with the recording-paper-roll supporting device including the first and second members, the following effect can be obtained. That is, in the case of replacing the recording paper roll with another recording paper roll having a different width, the adjustment can be performed only by the recording-paper-roll supporting device including the first and second members. Thus, the operability can be considerably improved.

DESCRIPTION OF THE PREFERRED EMBODIMENTS

An embodiment of the present invention will be described with reference to the drawings.

First, the basic structure of a printer 10 according to the present embodiment will be described.

Figure 1:
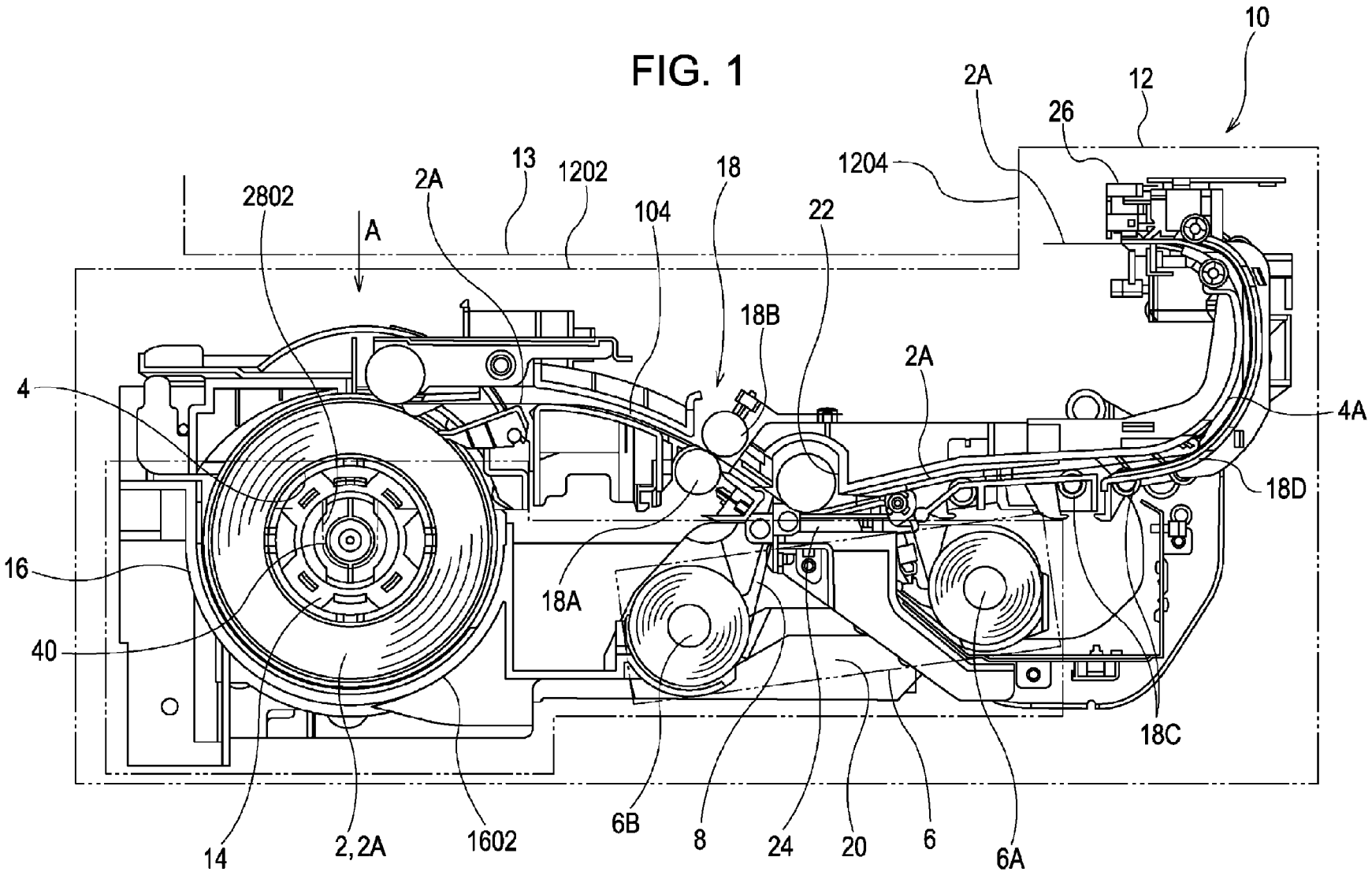
FIG. 1 is a sectional view illustrating the structure of a printer according to an embodiment.
Figure 2:
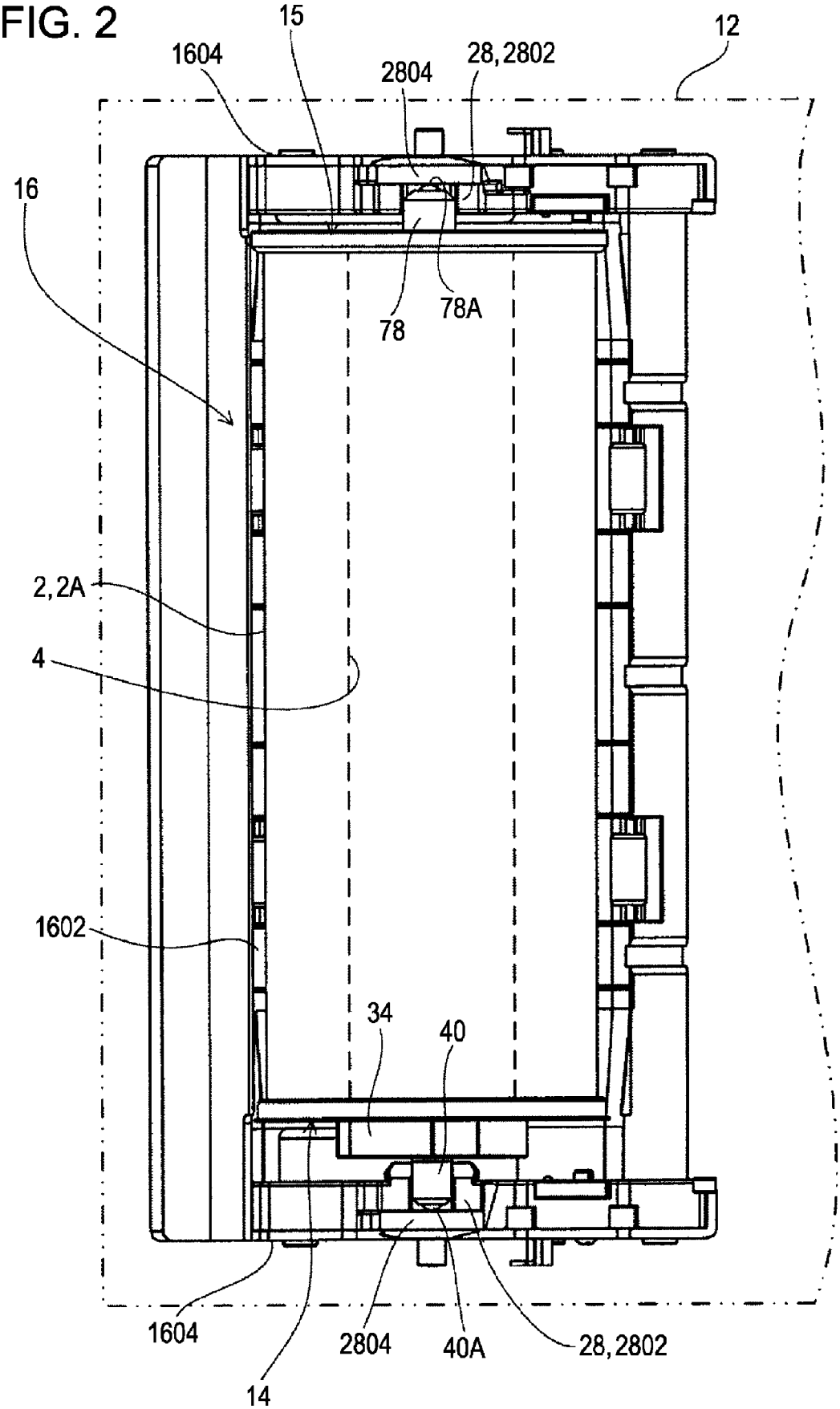
FIG. 2 is a plan view illustrating the state in which a first recording-paper-roll supporting device and a recording-paper-roll storage section are viewed in a direction shown by arrow A in FIG. 1.
Figure 3:
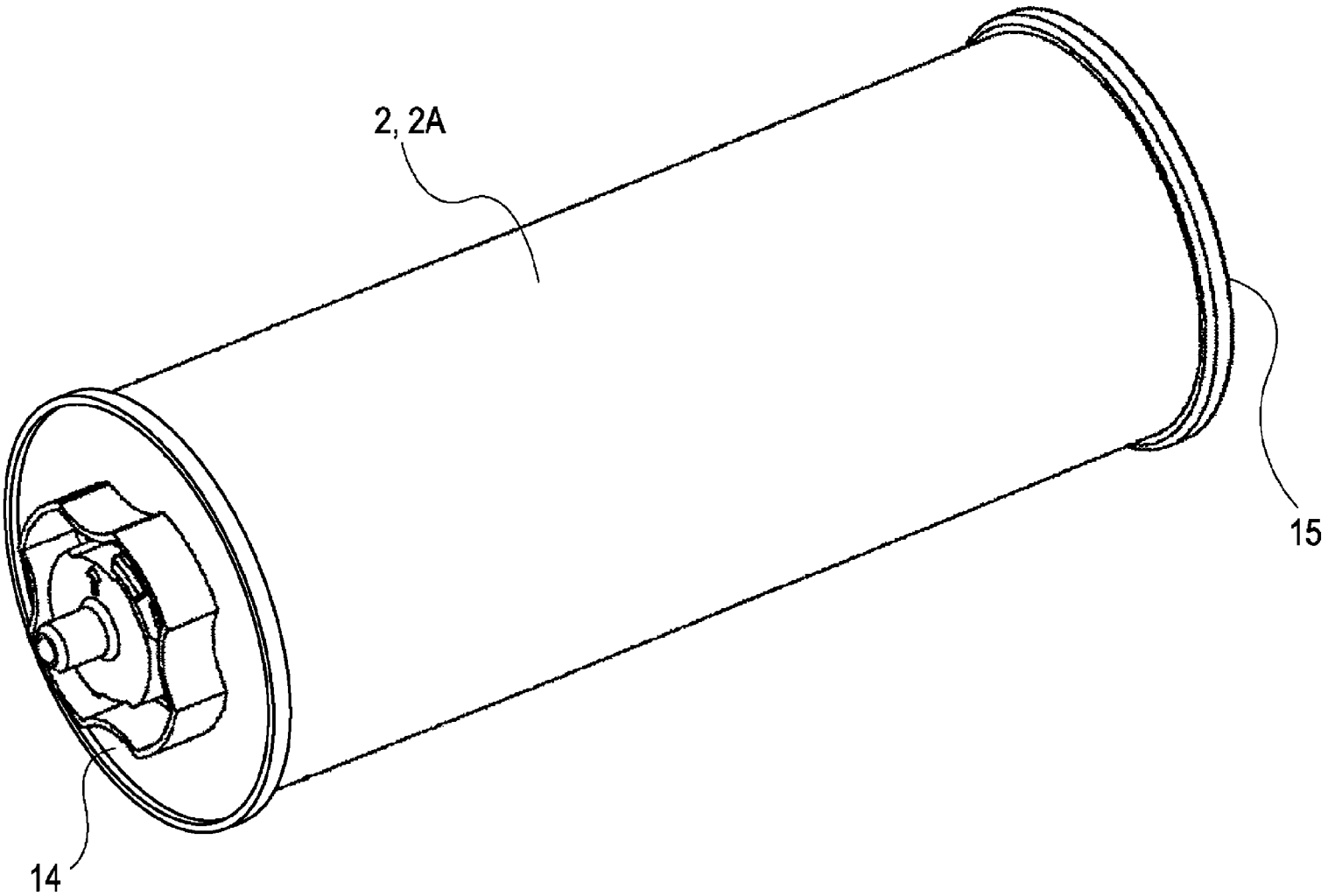
FIG. 3 is a perspective view illustrating the state in which a recording paper roll is supported by first and second recording-paper-roll supporting devices.

FIG. 1 is a sectional view illustrating the structure of the printer 10 according to the present embodiment. FIG. 2 is a plan view illustrating the state in which a first recording-paper-roll supporting device 14 and a recording-paper-roll storage section 16 are viewed in a direction shown by arrow A in FIG. 1. FIG. 3 is a perspective view illustrating the state in which a recording paper roll 2 is supported by the first recording-paper-roll supporting device 14 and a second recording-paper-roll supporting device 15.

First, the recording paper roll 2 will be described.

As shown in FIG. 3, the recording paper roll 2 is obtained by winding a sheet of recording paper 2A having a constant width into a roll.

A center hole 4 (see FIG. 2) is formed so as to extend between the ends of the recording paper roll 2 in the width direction thereof.

The recording paper roll 2 may either be formed by winding the recording paper 2A around a paper core or by winding the recording paper 2A without a paper core.

Next, the printer 10 will be described.

Referring to FIG. 1, the printer 10 is a dye-sublimation thermal printer which prints an image on the recording paper 2A unwound from the recording paper roll 2 by sublimating a sublimation material applied to an ink ribbon and transferring the material onto the recording paper 2A. The printing method used by the printer 10 is not limited to the dye-sublimation method, and various types of printing methods of the related art may be used.

The printer 10 includes a housing 12, and a tray-receiving recess 1202 is formed in the top surface of the housing 12. A paper output tray 13 is detachably attached to the tray-receiving recess 1202.

A paper output slot 1204 is formed in the housing 12 at a position where the paper output slot 1204 faces the paper output tray 13 attached to the tray-receiving recess 1202.

The recording-paper-roll storage section 16, a conveying unit 18, an ink-ribbon-cassette storage section 20, a platen roller 22, a print head 24, a cutter device 26, etc., are installed in the housing 12.

The first and second recording-paper-roll supporting devices 14 and 15 (see FIG. 3) according to the embodiment of the present invention are attached to the recording paper roll 2 at one and the other ends thereof. In this state, the recording paper roll 2 is stored in the recording-paper-roll storage section 16.

The recording paper 2A is unwound from the recording paper roll 2 and is conveyed along a conveying path 104. Then, the recording paper 2A is cut by the cutter device 26 and is ejected onto the paper output tray 13 through the paper output slot 1204.

As shown in FIGS. 1 and 2, the recording-paper-roll storage section 16 includes a semicylindrical bottom wall 1602 and side walls 1604. The bottom wall 1602 is open at the top and extends along the outer peripheral surface of the recording paper roll 2. The side walls 1604 stand upright at the ends of the bottom wall 1602 in the longitudinal direction thereof and face the ends of the recording paper roll 2.

The side walls 1604 are provided with respective bearings 28 which support support shafts 40 and 78 of the first and second recording-paper-roll supporting devices 14 and 15, respectively, in a rotatable manner.

Each bearing 28 includes a semicylindrical bearing wall 2802 (see FIGS. 1 and 2) which opens at the top and a contact wall 2804 (see FIG. 2) with which an end of the corresponding support shaft is brought into contact.

Referring to FIG. 1, the conveying unit 18 conveys the recording paper 2A unwound from the recording paper roll 2 stored in the recording-paper-roll storage section 16 in a forward direction. The recording paper 2A is conveyed along the conveying path 104 such that the recording paper 2A passes by the print head 24 and is guided to the cutter device 26. The conveying unit 18 also conveys the recording paper 2A in a reverse direction in which the recording paper 2A is wound around the recording paper roll 2. The recording paper 2A is conveyed in the forward and reverse directions as described above in a printing operation.

According to the present embodiment, the conveying path 104 includes a substantially horizontal section which extends from the recording-paper-roll storage section 16 to the print head 24 and a turning section 4A which is connected to the substantially horizontal section and extends from the print head 24 to the cutter device 26. The turning section 4A is curved in a U-shape and is bent by 180 degrees.

The conveying unit 18 includes a pinch roller 18A and a capstan 18B which convey the recording paper 2A in the forward or reverse direction by rotating in a forward or reverse direction while nipping the recording paper 2A therebetween in the thickness direction of the recording paper 2A. The conveying unit 18 also includes a plurality of guide rollers 18C and a guide member 18D.

An ink ribbon cassette 6 which houses an ink ribbon 8 sectioned in accordance with colors of ink is detachably stored in the ink-ribbon-cassette storage section 20.

The ink ribbon 8 is unwound from an ink-ribbon supply reel 6A disposed in the ink ribbon cassette 6, is guided by guide rollers (not shown) such that the ink ribbon 8 is conveyed between the platen roller 22 and the print head 24, and is wound around an ink-ribbon take-up reel 6B disposed in the ink ribbon cassette 6.

The platen roller 22 and the print head 24 face each other across the conveying path 104.

The recording paper 2A is in contact with an outer peripheral surface of the platen roller 22, and the ink ribbon cassette 6 is positioned on a side of the recording paper 2A that is opposite to the platen roller 22. Thus, the ink ribbon cassette 6 is positioned between the recording paper 2A and the print head 24.

The print head 24 is movable between a print position and a standby position. At the print position, the print head 24 is disposed near the platen roller 22 and operates in association with the platen roller 22 so as to press the ink ribbon cassette 6 against the recording paper 2A. At the standby position, the print head 24 is separated from the platen roller 22 and the ink ribbon cassette 6 is released from the recording paper 2A.

While the recording paper 2A is being conveyed by the conveying unit 18 and the print head 24 is positioned at the print position, a plurality of heating elements included in the print head 24 are selectively driven by applying a current thereto on the basis of gradation data. Accordingly, the sublimation material on the ink ribbon 8 is sublimated and is transferred onto the recording paper 2A. Thus, an image is formed on the recording paper 2A.

In the process of printing an image on the recording paper 2A, first the recording paper 2A is moved, for example, in the forward direction by a predetermined distance by the conveying unit 18 while the print head 24 is at the standby position. Then, the print head 24 is moved to the print position and is driven while the recording paper 2A is moved in the reverse direction by a predetermined distance by the conveying unit 18.

The printing operation is performed while the pinch roller 18A and the capstan 18B hold the recording paper 2A therebetween and convey the recording paper 2A, and a printed area is formed accordingly. Thus, printed areas and unprinted areas positioned between the printed areas are obtained. The unprinted areas extend over the entire width of the recording paper 2A.

Thus, the printed areas and the unprinted areas are alternately formed along the length direction of the recording paper 2A.

The cutter device 26 is disposed near the paper output slot 1204, and cuts the printed areas and unprinted areas from each other. The printed areas of the recording paper 2A cut by the cutter device 26 are output as printed sheets, and the unprinted areas of the recording paper 2A cut by the cutter device 26 are output as cut-out pieces.

Although not shown in the figure, the cutter device 26 includes a circular rotating blade which moves along the width direction of the recording paper 2A while rotating around a rotational shaft, and a fixed blade which extends in the width direction of the recording paper 2A along the locus of the rotating blade. The rotating blade rotates and moves while being in contact with the fixed blade, and thereby cuts the recording paper 2A. The structure of the cutter device 26 is not limited to the rotary type in which a cutter is rotated, and various common structures may be applied.

Next, the main structure of the embodiment of the present invention will be described.

Figure 4:
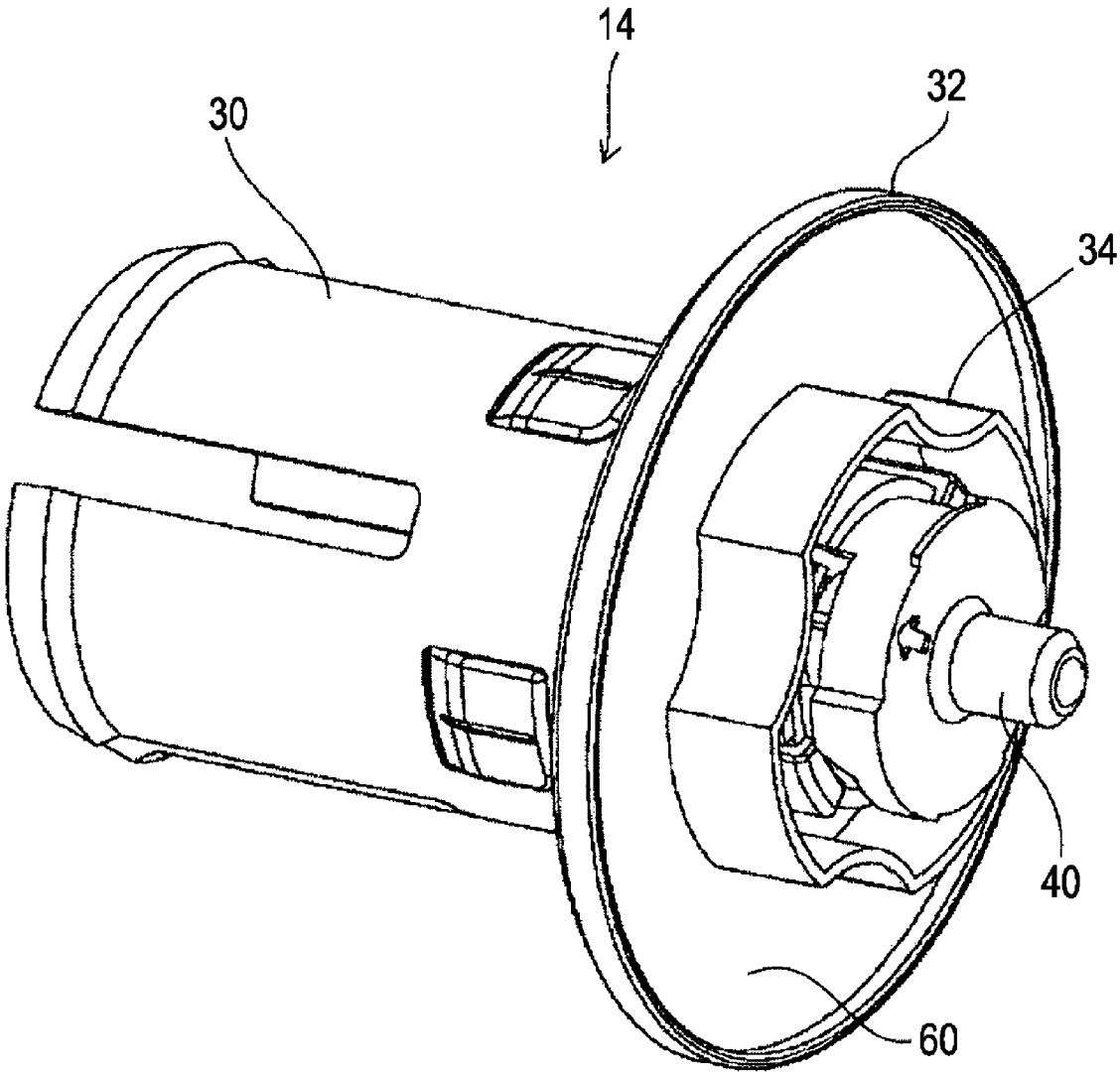
FIG. 4 is a perspective view of the first recording-paper-roll supporting device.
Figure 5:
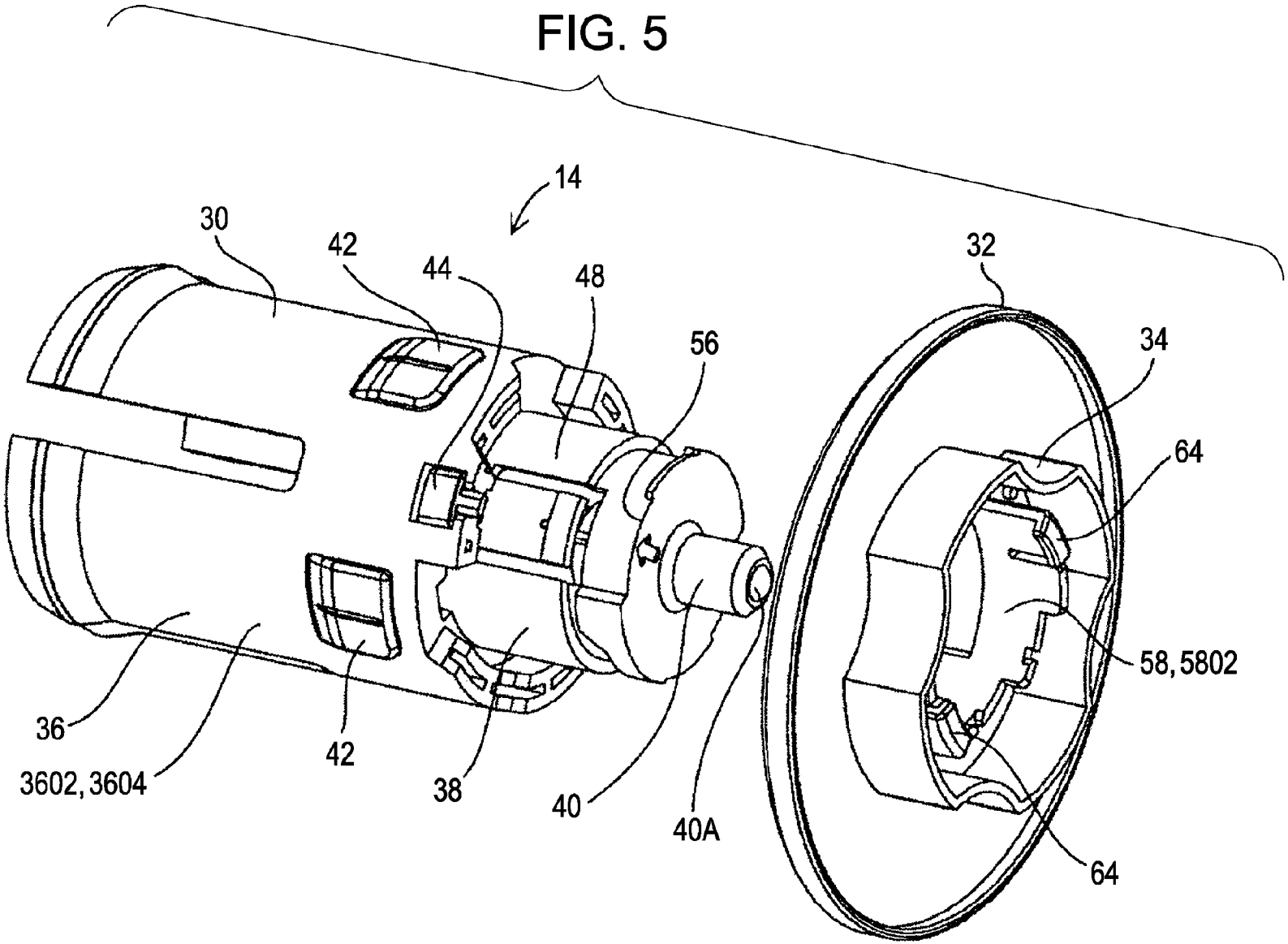
FIG. 5 is an exploded perspective view of the first recording-paper-roll supporting device.
Figure 6:
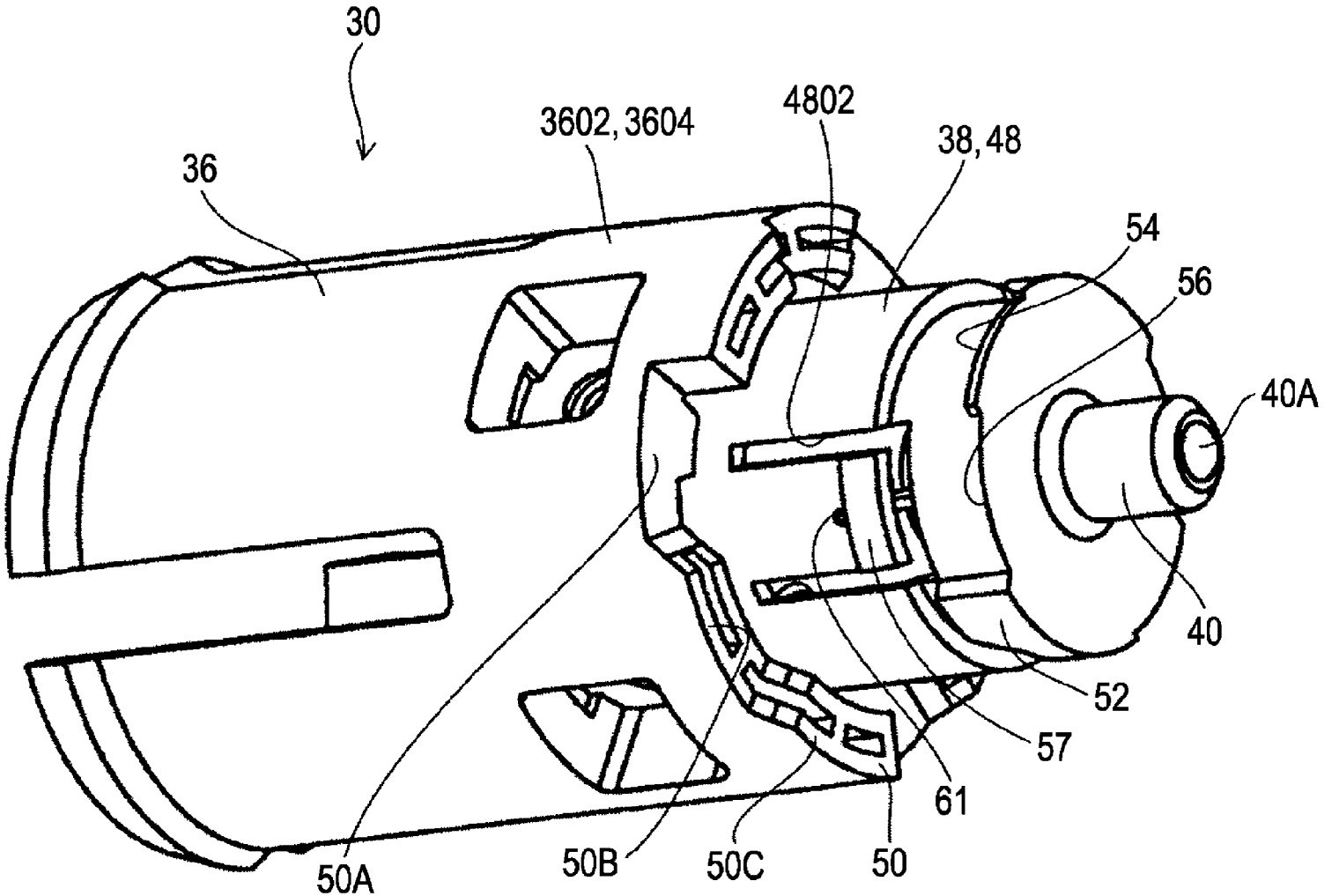
FIG. 6 is a perspective view of a first member.
Figure 7:
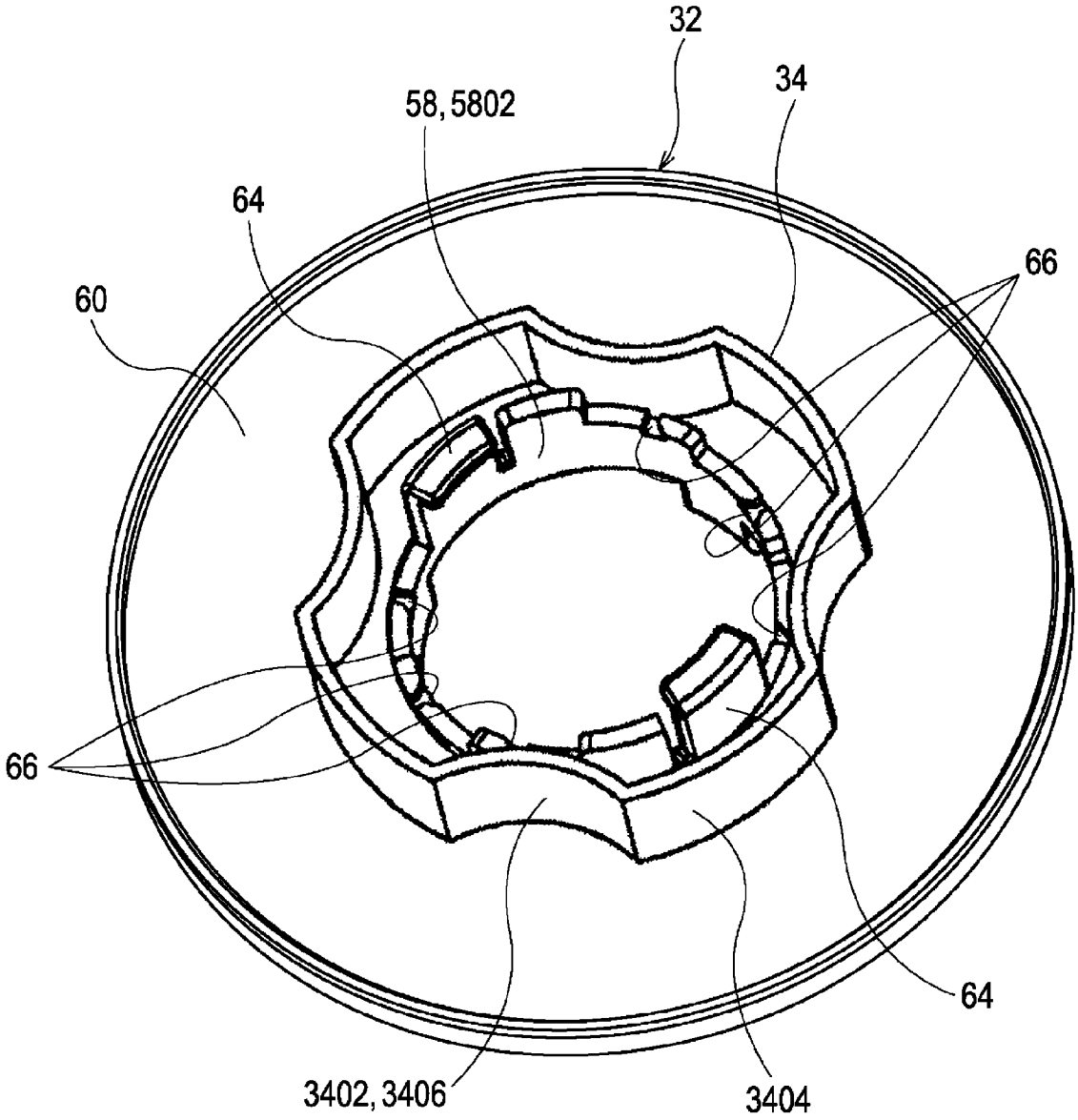
FIG. 7 is a perspective view of a second member.
Figure 8:
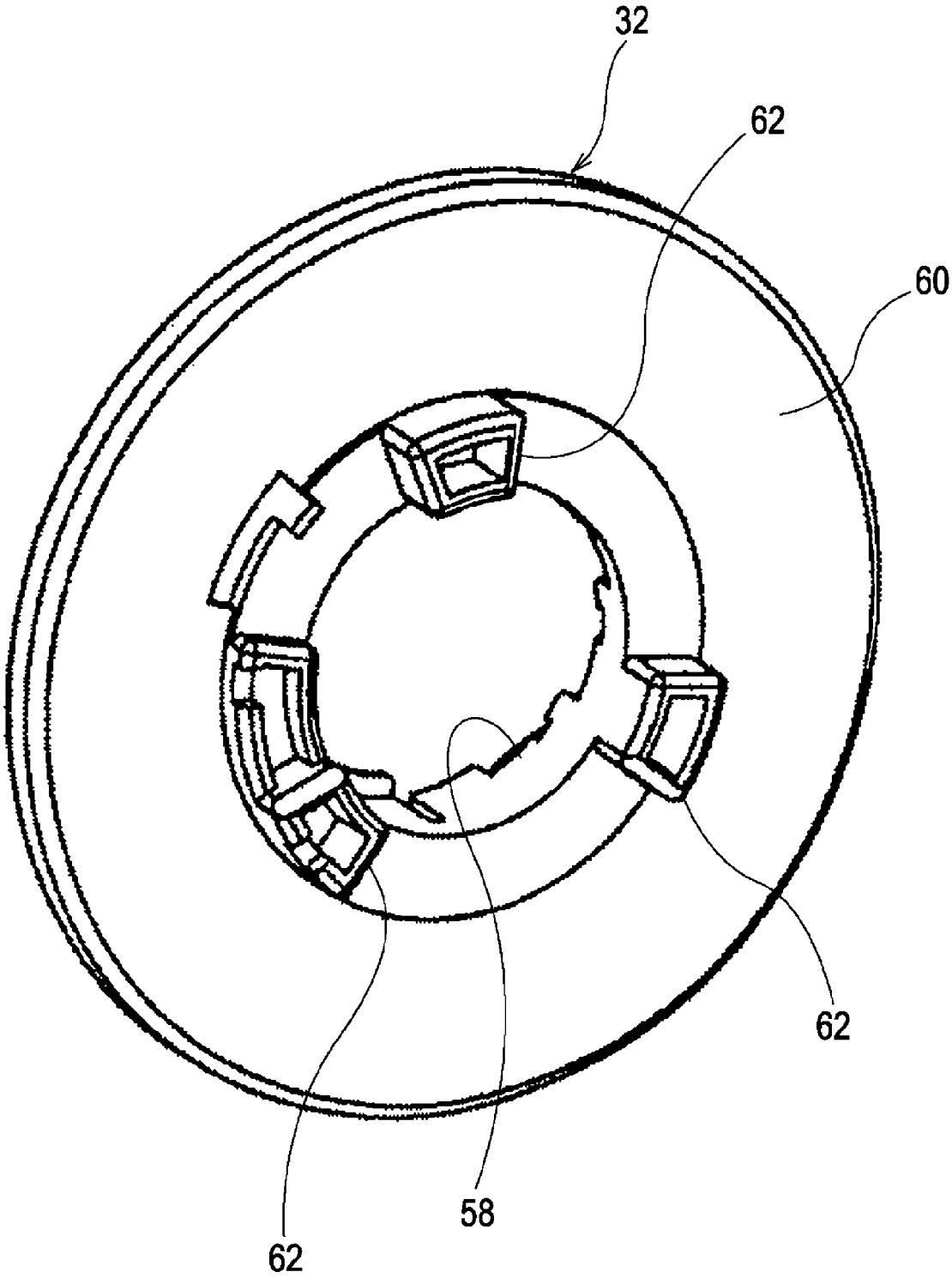
FIG. 8 is a perspective view of the second member in the vertically reversed state.
Figure 9:
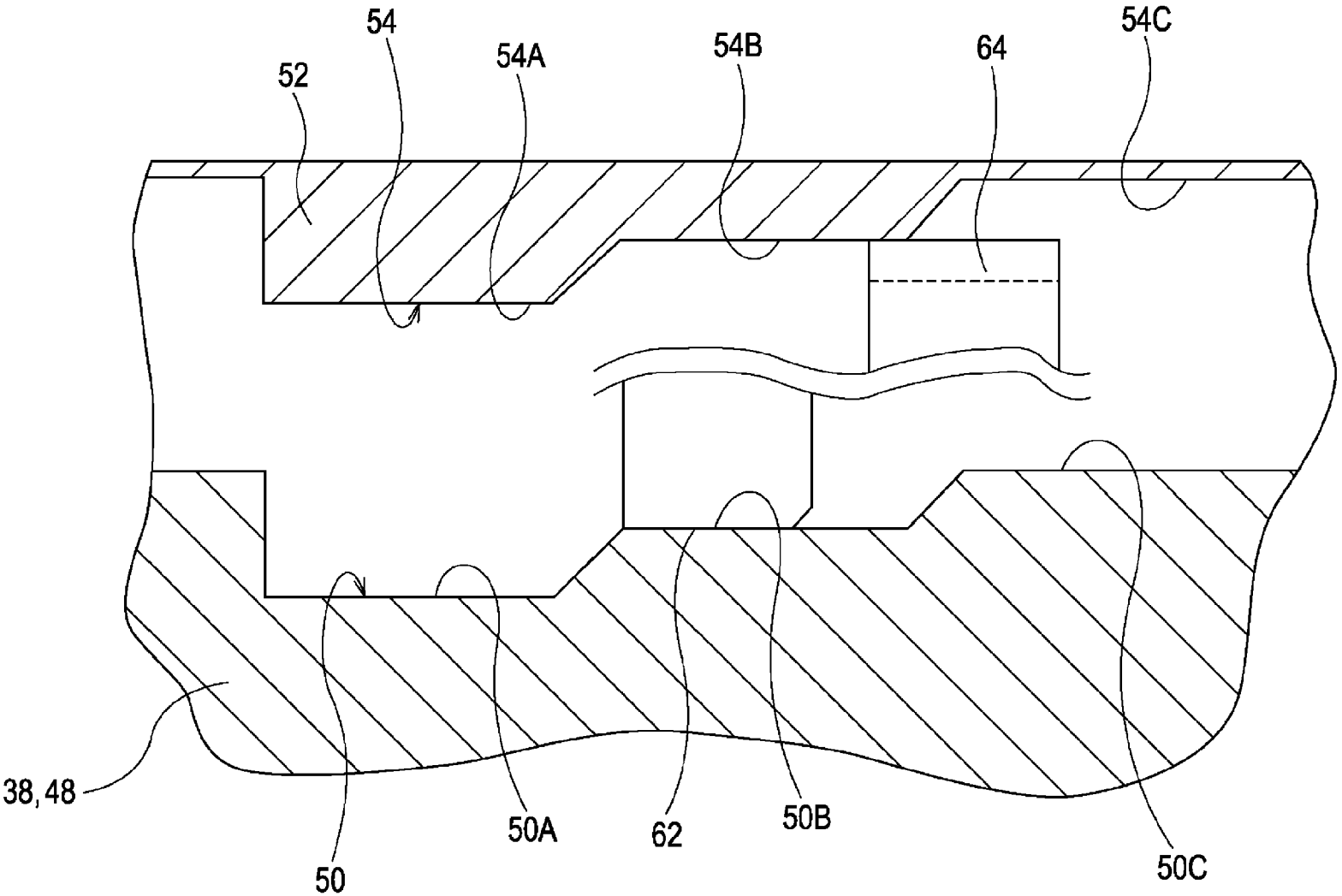
FIG. 9 is a planar development of insertion-portion-side cam surfaces and support-shaft-side cam surfaces.
Figure 10:
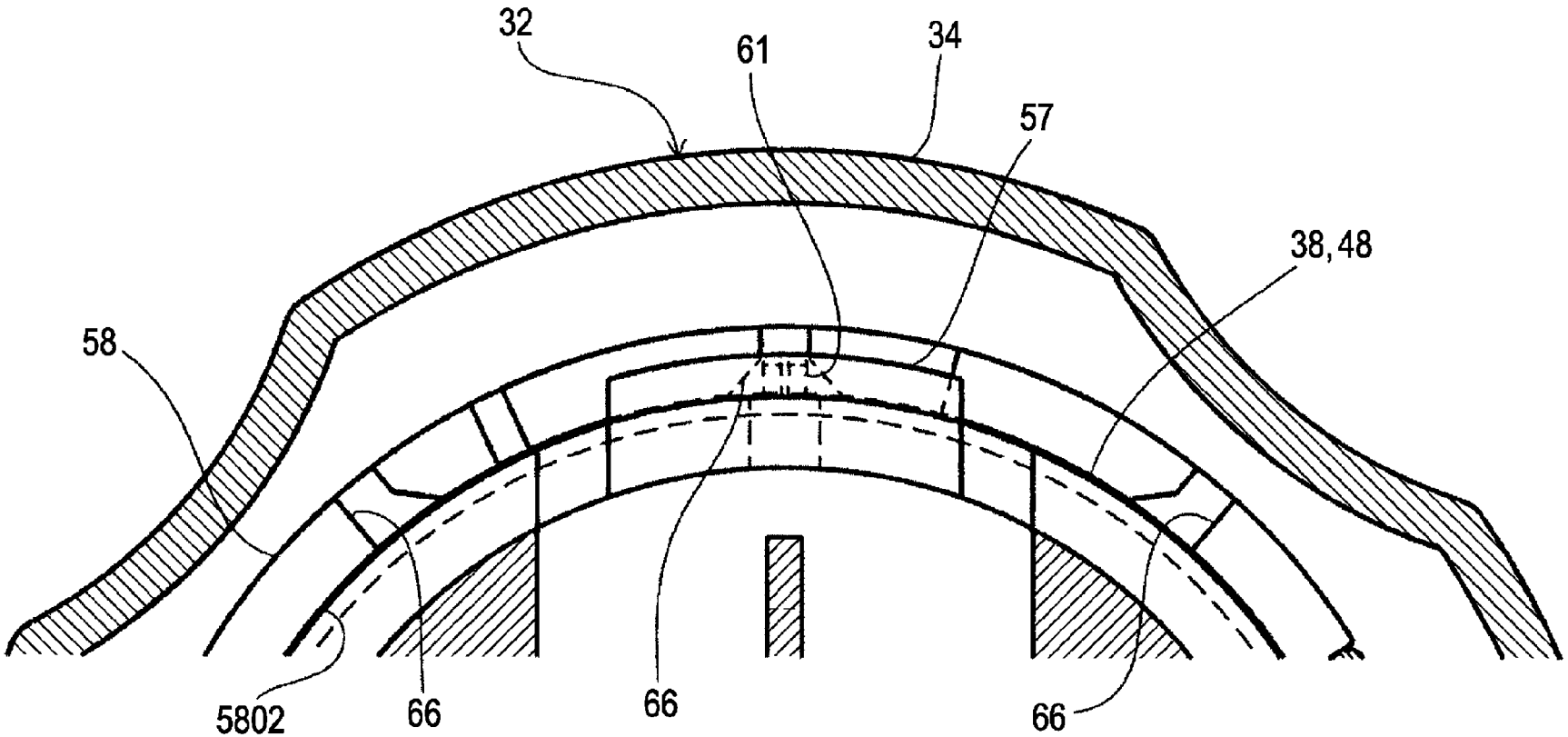
FIG. 10 is a sectional view illustrating an engaging projection and engaging recesses.
Figure 11:
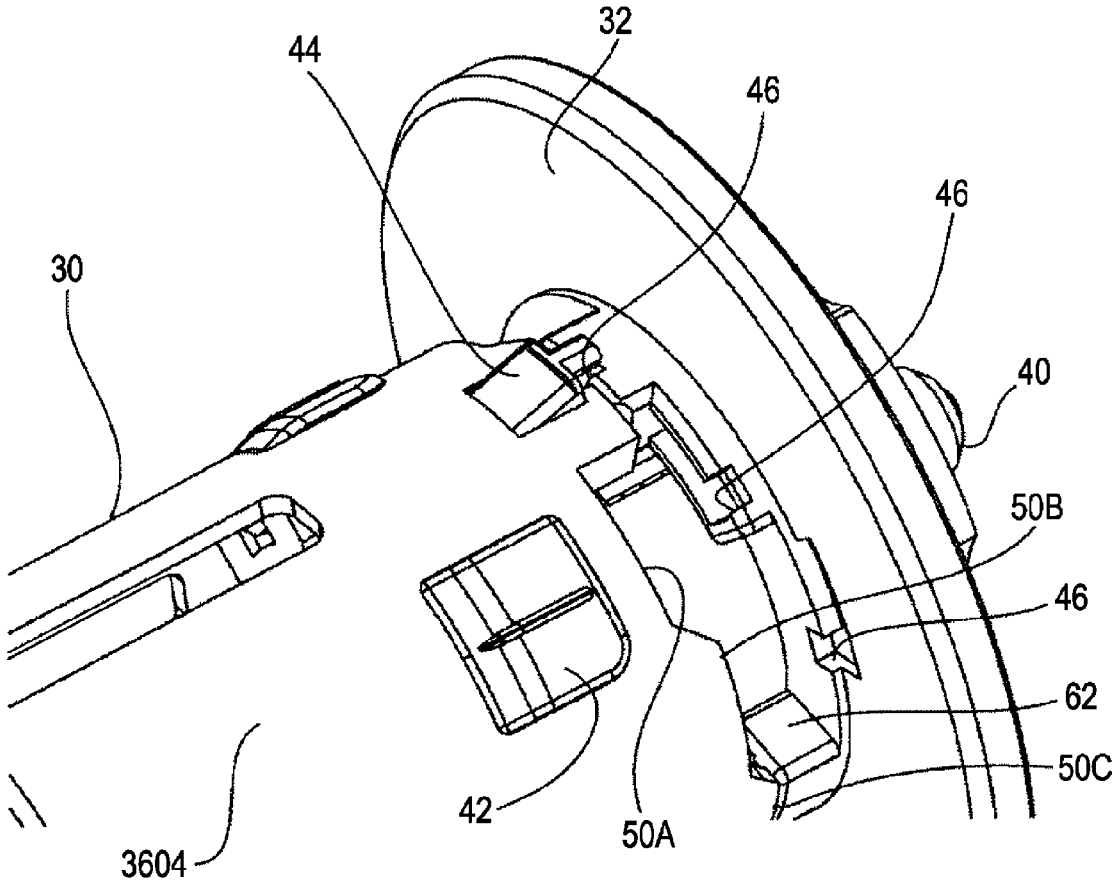
FIG. 11 is a perspective view illustrating the operation of a lock piece and cut sections.
Figure 12:
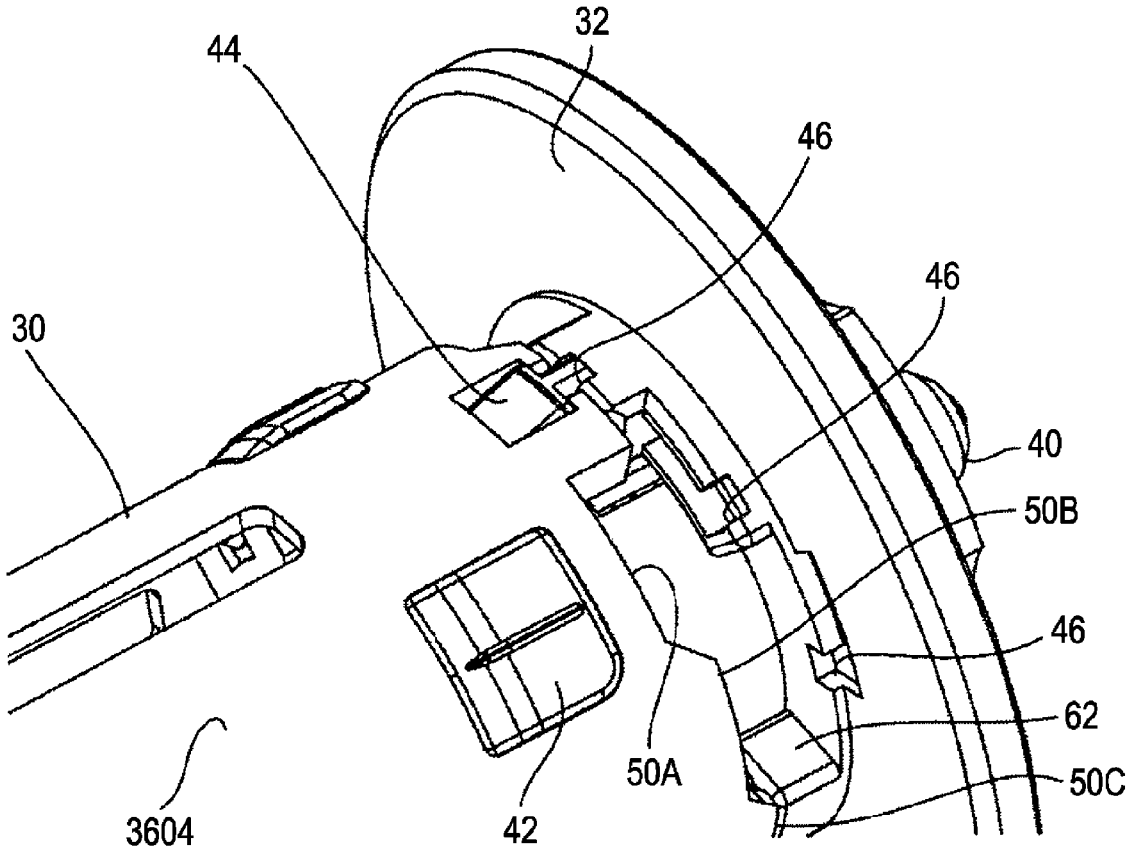
FIG. 12 is another perspective view illustrating the operation of the lock piece and cut sections.
Figure 13A:
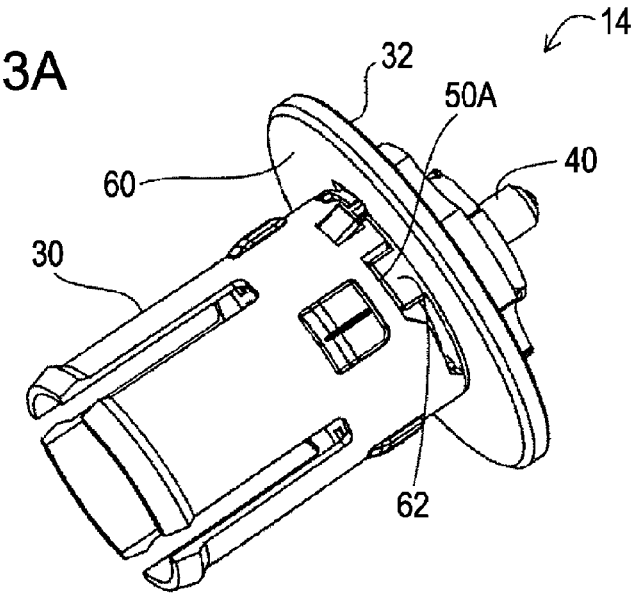
FIGS. 13A to 13C are perspective views illustrating the operation of the first member and the second member.
Figure 13B:
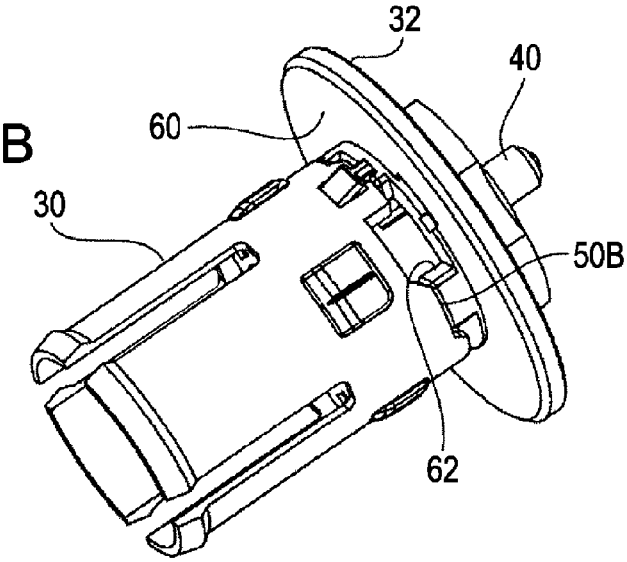
Figure 13C:
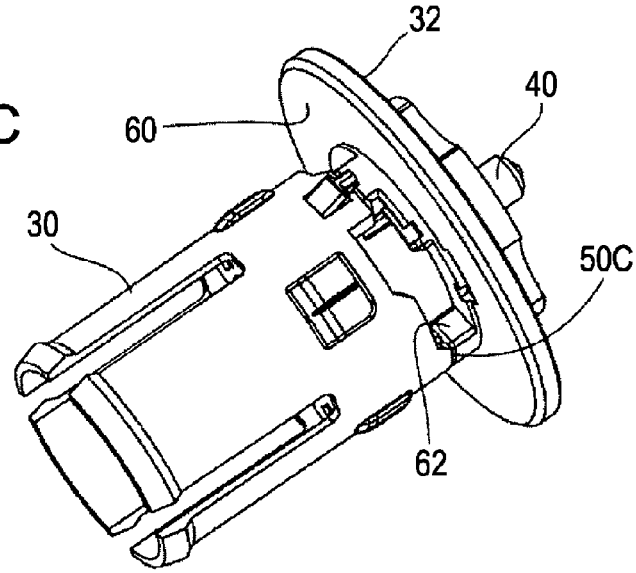

FIG. 4 is a perspective view of the first recording-paper-roll supporting device 14. FIG. 5 is an exploded perspective view of the first recording-paper-roll supporting device 14. FIG. 6 is a perspective view of a first member 30. FIG. 7 is a perspective view of a second member 32. FIG. 8 is a perspective view of the second member 32 in the vertically reversed state. FIG. 9 is a planar development of insertion-portion-side cam surface 50 and support-shaft-side cam surface 54. FIG. 10 is a sectional view illustrating an engaging projection 61 and engaging recesses 66. FIGS. 11 and 12 are perspective views illustrating the operation of a lock piece 44 and cut sections 46. FIGS. 13A to 13C are perspective views illustrating the operation of the first member 30 and the second member 32.

Referring to FIGS. 2 and 3, the first recording-paper-roll supporting device 14 is attached to the center hole 4 at one end thereof in the longitudinal direction of the recording paper roll 2, and the second recording-paper-roll supporting device 15 is attached to the center hole 4 at the other end thereof in the longitudinal direction of the recording paper roll 2.

As shown in FIGS. 4 and 5, the first recording-paper-roll supporting device 14 includes the first member 30 and the second member 32.

As shown in FIG. 5, the first member 30 includes an insertion portion 36 inserted into the center hole 4 at one end of the recording paper roll 2, a supporting portion 38 provided at an end of the insertion portion 36, and a support shaft 40 provided at an end of the supporting portion 38.

As shown in FIG. 5, the insertion portion 36 includes a cylindrical wall 3602, and pressing pieces 42 and a lock piece 44 are provided on an outer peripheral surface 3604 of the cylindrical wall 3602.

The pressing pieces 42 are pressed by the inner peripheral surface of the center hole 4 so that the first member 30 can be attached to the center hole 4 without rattling.

The pressing pieces 42 are biased so as to project from the outer peripheral surface 3604 by a predetermined distance. The pressing pieces 42 are biased by coil springs 4202 (see FIG. 15) and are arranged along the circumferential direction of the outer peripheral surface 3604 with intervals therebetween.

Referring to FIGS. 11 and 12, the lock piece 44 is biased so as to project from the outer peripheral surface 3604 by a predetermined distance. When the first recording-paper-roll supporting unit 14 is inserted into the center hole 4, the lock piece 44 is pushed inward in the radial direction by the inner peripheral surface of the center hole 4 and becomes engaged with one of the cut sections 46 in the second member 32 so as to stop the rotation of the second member 32 relative to the first member 30.

Referring to FIG. 6, the supporting portion 38 includes an outer peripheral surface 48, insertion-portion-side cam surfaces 50, a collar portion 52, support-shaft-side cam surfaces 54, and cut sections 56.

The outer peripheral surface 48 is formed coaxially with the cylindrical wall 3602 of the insertion portion 36.

Two click claws 57, which form a part of a click mechanism, are arranged on the outer peripheral surface 48 with intervals therebetween in the circumferential direction. The click claws 57 are sectioned by slits 4802 in the outer peripheral surface 48, and engaging projections 61 are provided at the ends of the click claws 57.

As shown in FIGS. 6 and 9, the insertion-portion-side cam surfaces 50 are formed at an end of the outer peripheral surface 48 that is adjacent to the insertion portion 36.

More specifically, the insertion-portion-side cam surfaces 50 include three cam surfaces, which are a first cam surface 50A, a second cam surface 50B, and a third cam surface 50C, arranged in an annular area outside the outer peripheral surface 48 in the radial direction at the end of the outer peripheral surface 48 that is adjacent to the insertion portion 36. The first, second, and third cam surfaces 50A, 50B, and 50C face the outer peripheral surface 48 and are disposed at different heights in the axial direction and at different phases in the circumferential direction. Three sets of insertion-portion-side cam surfaces 50, each set including the three cam surfaces 50A, 50B, and 50C, are arranged in the circumferential direction with intervals therebetween.

The collar portion 52 is provided at an end of the outer peripheral surface 48 that is adjacent to the support shaft 40 and has a diameter larger than the diameter of the outer peripheral surface 48 at the end adjacent to the support shaft 40.

As shown in FIGS. 6 and 9, the support-shaft-side cam surfaces 54 are provided at an end of the collar portion 52 that is adjacent to the support shaft 40. The support-shaft-side cam surfaces 54 include three cam surfaces, which are a fourth cam surface 54A, a fifth cam surface 54B, and a sixth cam surface 54C, disposed at different heights in the axial direction and at different phases in the circumferential direction. Two sets of support-shaft-side cam surfaces 54, each including the three cam surfaces 54A, 54B, and 54C, are arranged in the circumferential direction with intervals therebetween.

As shown in FIG. 6, the cut sections 56 are formed in an outer peripheral area of the collar portion 52.

The support shaft 40 serves as a support shaft for the recording paper roll 2, and a spherical surface 40A is formed at an end of the support shaft 40. As shown in FIG. 2, the spherical surface 40A is brought into contact with the contact wall 2804 of the corresponding bearing 28.

As shown in FIGS. 5, 7, and 8, the second member 32 includes a cylindrical portion 58, a flange portion 60, cam followers 62, engaging claws 64, and an operating knob 34.

The cylindrical portion 58 has a cylindrical shape and includes an inner peripheral surface 5802 along which the outer peripheral surface 48 is inserted.

As shown in FIGS. 7 and 10, at each of two positions on the inner peripheral surface 5802 that are spaced from each other in the circumferential direction, three engaging recesses 66, which are engageable with the corresponding engaging projection 61, are arranged along the circumferential direction with intervals therebetween. The click claws 57, the engaging projections 61, and the engaging recesses 66 form the click mechanism which generates a click feeling each time the second member 32 is rotated relative to the first member 30 by a predetermined angle.

As shown in FIG. 7, the flange portion 60 is provided on the cylindrical portion 58 such that the flange portion is coaxial with the cylindrical portion 58, and has a diameter larger than the diameter of the cylindrical portion 58. In the state in which the insertion portion 36 is inserted into the center hole 4, the flange portion 60 comes into contact with an end of the recording paper roll 2 in a width direction of the recording paper 2A.

As shown in FIG. 8, the cam followers 62 are disposed at an end of the cylindrical portion 58 in the axial direction thereof. Three cam followers 62 are arranged along the circumferential direction of the cylindrical portion 58 with intervals therebetween. Each cam follower is selectively engageable with the insertion-portion-side cam surfaces 50.

As shown in FIG. 9, the engaging claws 64 can be inserted through the cut sections 56 (see FIG. 6) and be disposed on the supporting portion 38. Two engaging claws are arranged along the circumferential direction of the cylindrical portion 58 with intervals therebetween. Each engaging claw 64 is selectively engageable with the support-shaft-side cam surfaces 54.

As shown in FIG. 7, the operating knob 34 is provided on the cylindrical portion 58 at a position closer to the engaging claws 64 than the flange portion 60, and has a diameter larger than that of the cylindrical portion 58 and smaller than that of the flange portion 60.

The operating knob 34 includes an annular wall 3402 which projects from a surface of the flange portion 60 so as to surround the cylindrical portion 58. The annular wall 3402 includes arc-shaped wall portions 3404 curved outward in the radial direction and arc-shaped wall portions 3406 curved inward in the radial direction, and the arc-shaped wall portions 3404 and 3406 are alternately arranged along the circumferential direction.

Thus, the operating knob 34 is formed of the annular wall 3402 which extends continuously in the circumferential direction of the cylindrical portion 58. Therefore, dust can be prevented from entering and the reliability and safety can be increased.

Referring to FIG. 5, the engaging claws 64 can be inserted through the cut sections 56 and be disposed on the supporting portion 38, and the outer peripheral surface 48 can be inserted along the inner peripheral surface 5802 so that the cylindrical portion 58 can be supported by the supporting portion 38. In addition, as shown in FIG. 9, each cam follower 62 can be selectively engaged with the first, second, and third cam surfaces 50A, 50B, and 50C, and each engaging claw 64 can be selectively engaged with the fourth, fifth, and sixth cam surfaces 54A, 54B, and 54C. In this state, the engaging claws 64 are elastically deformed in the axial direction by the support-shaft-side cam surfaces 54, and thereby generate a reactive force which presses the cam followers 62 against the insertion-portion-side cam surfaces 50. Thus, the second member 32 is positioned on the supporting portion 38 in the axial direction.

The state in which the second member 32 is positioned as described above is stably maintained by causing the engaging projections 61 to engage with the engaging recesses 66, as shown in FIG. 10.

Thus, the position of the flange portion 60 on the support shaft 40 is adjusted by the insertion-portion-side cam surfaces 50 and the support-shaft-side cam surfaces 54. Then, the insertion portion 36 is attached to the center hole 4. Accordingly, the lock piece 44 is pressed inward in the radial direction by the inner peripheral surface of the center hole 4 and engages with one of the cut sections 46 in the second member 32, thereby stopping the rotation of the second member 32 relative to the first member 30.

In the present embodiment, the second member 32 is attached to the first member 30 in an undetachable manner.

More specifically, as described above, the engaging claws 64 are inserted through the cut sections 56 and are disposed on the supporting portion 38, and the outer peripheral surface 48 is inserted along the inner peripheral surface 5802 so that the cylindrical portion 58 is supported by the supporting portion 38 and the second member 32 is attached to the first member 30. At this time, the click claws 57 are pushed by the engaging claws 64 and are elastically deformed inward in the radial direction.

Then, after the second member 32 is rotated so that the click claws 57 are released from the engaging claws 64 and the shape of the click claws 57 returns to the original shape, side surfaces of the click claws 57 and the engaging claws 64 at the ends in a direction perpendicular to the extending direction thereof can come into contact with each other.

Therefore, even if an operator tries to remove the second member 32 from the first member 30 by moving the engaging claws 64 to the positions corresponding to the cut sections 56, it is difficult to move the engaging claws 64 to the positions corresponding to the cut sections 56 since the side surfaces of the engaging claws 64 and the click claws 57 come into contact with each other. Thus, the second member 32 can be attached to the first member 30 in an undetachable manner.

Figure 14:
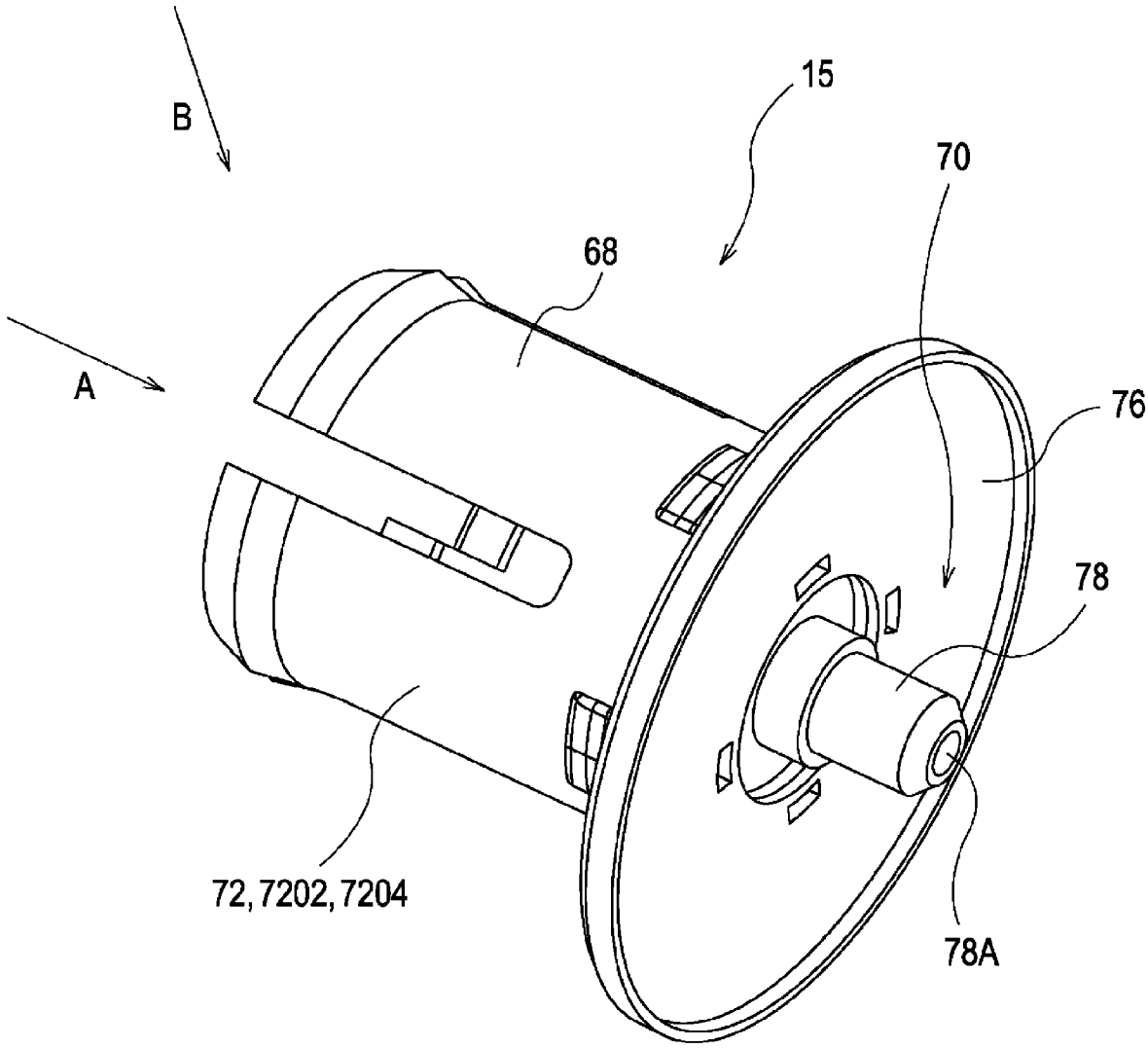
FIG. 14 is a perspective view of the second recording-paper-roll supporting device.
Figure 15:
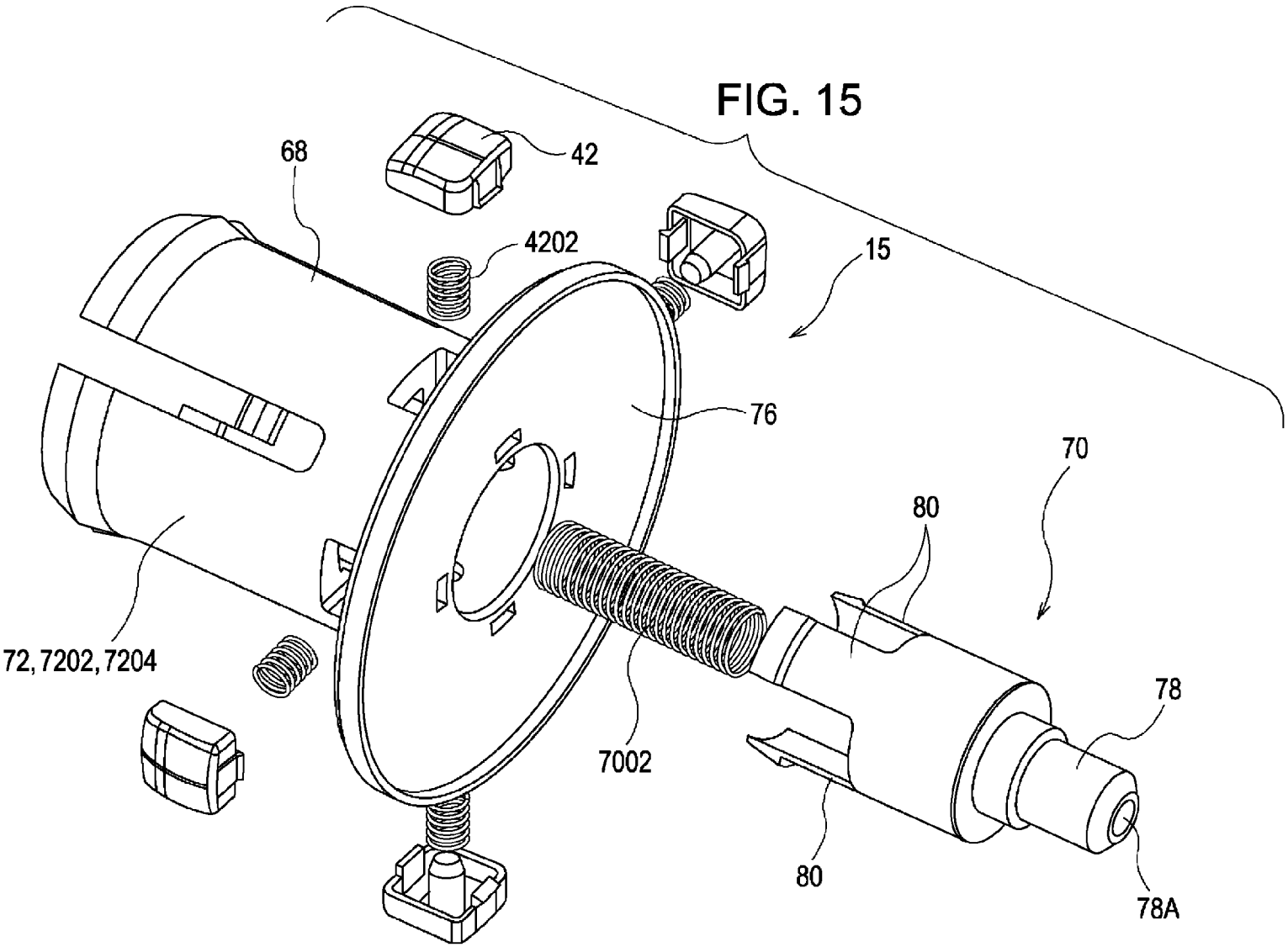
FIG. 15 is an exploded perspective view of the second recording-paper-roll supporting device.
Figure 16:
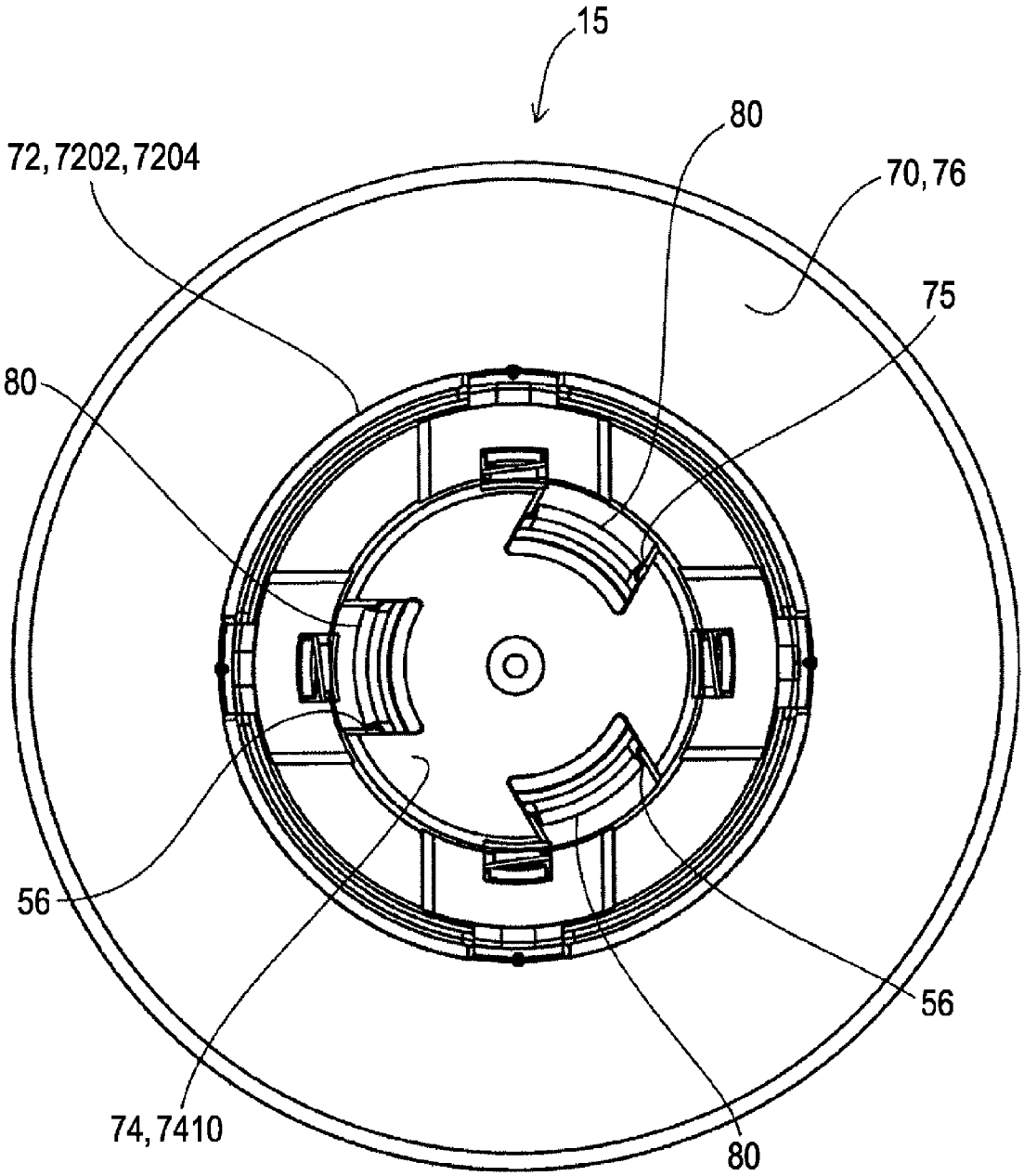
FIG. 16 is a diagram illustrating the structure in FIG. 14 viewed in a direction shown by arrow A.
Figure 17:
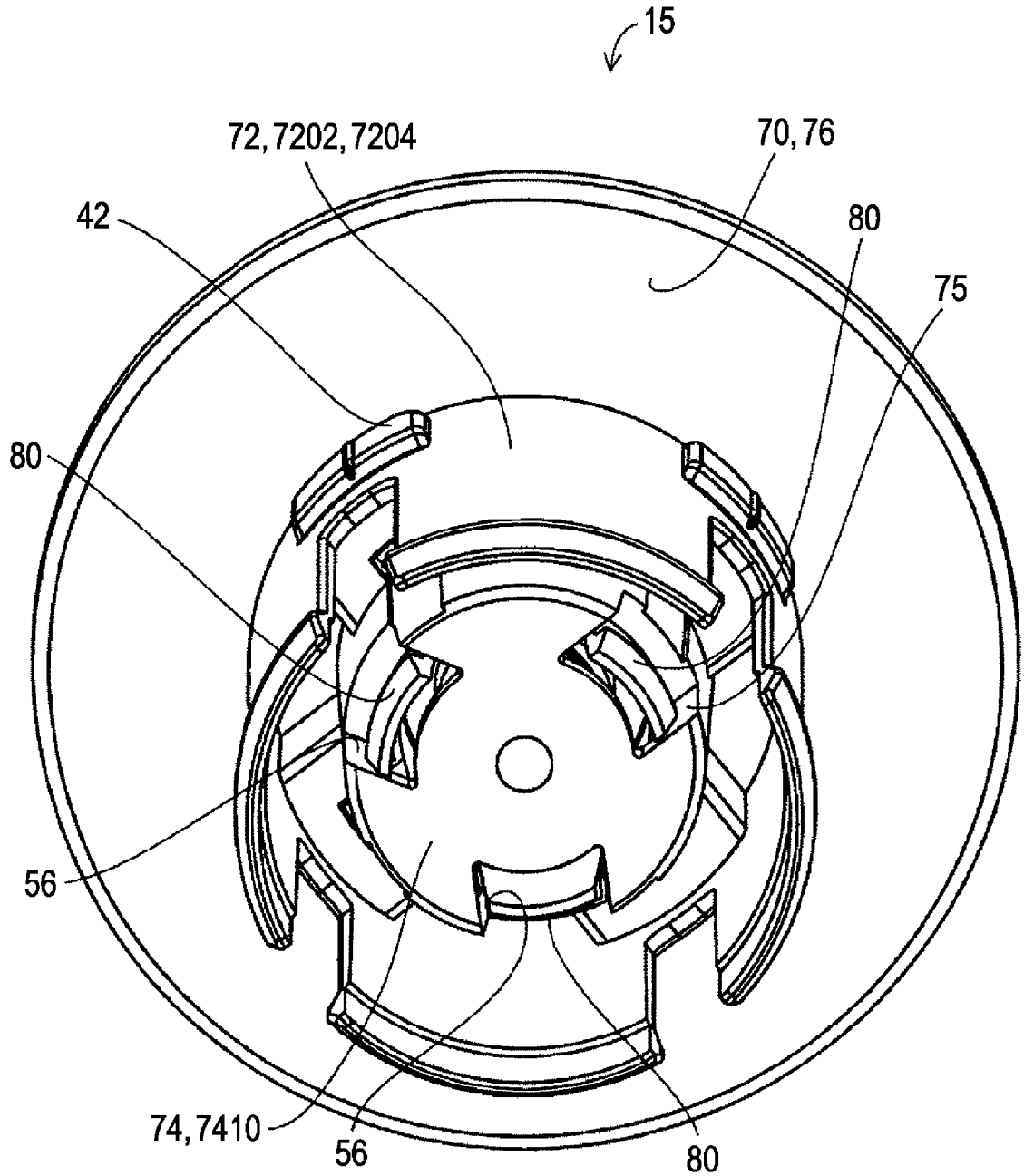
FIG. 17 is a perspective view of the structure in FIG. 14 viewed in a direction shown by arrow B.

FIG. 14 is a perspective view of the second recording-paper-roll supporting device 15. FIG. 15 is an exploded perspective view of the second recording-paper-roll supporting device 15. FIG. 16 is a diagram illustrating the structure in FIG. 14 viewed in a direction shown by arrow A. FIG. 17 is a perspective view of the structure in FIG. 14 viewed in a direction shown by arrow B.

As shown in FIGS. 14 and 15, the second recording-paper-roll supporting device 15 includes a third member 68 and a fourth member 70.

As shown in FIGS. 15 to 17, the third member 68 includes an insertion portion 72 inserted into the center hole 4 at an end of the recording paper roll 2, a cylindrical portion 74 disposed inside the insertion portion 72, and a flange portion 76 provided at an end of the insertion portion 72.

The insertion portion 72 includes a cylindrical wall 7202, and pressing pieces 42 are provided on an outer peripheral surface 7204 of the cylindrical wall 7202.

The pressing pieces 42 are pressed by the inner peripheral surface of the center hole 4 so that the third member 68 can be attached to the center hole 4 without rattling.

The pressing pieces 42 are biased so as to project from the outer peripheral surface 7204 by a predetermined distance. The pressing pieces 42 are biased by coil springs 4202 and are arranged along the circumferential direction of the outer peripheral surface 7204 with intervals therebetween.

The cylindrical portion 74 is coaxial with the cylindrical wall 7202, and three cut sections 75 are formed in the cylindrical portion 74 at positions spaced from each other in the circumferential direction of the cylindrical portion 74.

The flange portion 76 is formed on the insertion portion 72 such that the flange portion 76 is coaxial with the insertion portion 72, and has a diameter larger than that of the insertion portion 72. In the state in which the insertion portion 72 is inserted into the center hole 4, the flange portion 76 comes into contact with an end of the recording paper roll 2 in a width direction of the recording paper 2A.

As shown in FIG. 15, the fourth member 70 includes a support shaft 78 and engaging claws 80 provided at an end of the support shaft 78 and inserted into the cylindrical portion 74.

The support shaft 78 serves as a support shaft for the recording paper roll 2, and a spherical surface 78A is formed at an end of the support shaft 78. As shown in FIG. 2, the spherical surface 78A is brought into contact with the contact wall 2804 of the corresponding bearing 28.

As shown in FIGS. 16 and 17, three engaging claws 80 are arranged along the circumferential direction with intervals therebetween, and are engaged with the respective cut sections 75.

As shown in FIGS. 15 to 17, in the fourth member 70, a coil spring 7002 is disposed between a bottom wall 7410 of the cylindrical portion 74 and an inner base end of the engaging claws 80. In this state, the engaging claws 80 are inserted into the cylindrical portion 74 and are caused to engage with the respective cut sections 75. In other words, the fourth member 70 includes the support shaft 78 and the engaging claws 80 provided at an end of the support shaft 78, and the engaging claws 80 are disposed in the insertion portion 72 and engaged with the cut sections 75 in the insertion portion 72 while compressing the coil spring 7002.

The support shaft 78 is biased by the coil spring 7002 to a projecting position at which the engaging claws 80 engage with the cut sections 75, and is capable of being pushed inward toward the insertion portion 72. In other words, the support shaft 78 can be moved in a range corresponding to the movable range of the engaging claws 80 in the cut sections 75.

The insertion portion 72 of the second recording-paper-roll supporting device 15, which is obtained by assembling the third member 68 and the fourth member 70 together as described above, is attached to the center hole 4.

Next, a method for using the first and second recording-paper-roll supporting devices 14 and 15 will be described.

In this example, a case will be considered in which three types of recording paper rolls 2 with different dimensions in the width direction of the recording paper 2A, that is, recording paper rolls 2 of an A4 size, a letter size, and an 8-inch size, are provided as recording paper rolls 2 that can be used in the printer 10.

First, the operator holds the first member 30 and the second member 32 of the first recording-paper-roll supporting device 14 and rotates the second member 32 relative to the first member 30 (FIGS. 13A to 13C).

Accordingly, each cam follower 62 is selectively engaged with one of the first, second, and third cam surfaces 50A, 50B, and 50C. Thus, the second member 32 can be positioned relative to the support shaft 40 in the axial direction. In other words, the flange portion 60 can be positioned relative to the support shaft 40 in the axial direction in accordance with the dimension of the recording paper roll 2 in the width direction. At this time, the second member 32 can be easily rotated by grabbing the operating knob 34.

After the above-mentioned positioning process, the insertion portion 36 is inserted into the center hole 4 at one end of the recording paper roll 2, and the flange portion 60 is brought into contact with that end of the recording paper roll 2.

Then, the insertion portion 72 of the second recording-paper-roll supporting device 15 is inserted into the center hole 4 at the other end of the recording paper roll 2 and the flange portion 76 is brought into contact with that end of the recording paper roll 2.

Thus, the first and second recording-paper-roll supporting devices 14 and 15 are respectively attached to one and the other ends of the recording paper roll 2.

Then, the recording paper roll 2, to which the first and second recording-paper-roll supporting devices 14 and 15 are attached, is stored in the recording-paper-roll storage section 16 of the printer 10.

More specifically, the support shafts 40 and 78 are fitted to the respective bearings 28 while the support shaft 78 is pushed inward toward the insertion portion 72.

Thus, the outer peripheral surfaces of the support shafts 40 and 78 are fitted to the respective bearing walls 2802, and the spherical surfaces 40A and 78A of the support shafts 40 and 78, respectively, are brought into contact with the respective contact walls 2804 by the urging force applied by the coil spring 7002. Therefore, the frictional force applied between the support shafts 40 and 78 and the respective contact walls 2804 is extremely small, and smooth rotation of the recording paper roll 2 can be ensured.

Since the support shaft 40 is brought into contact with the corresponding contact wall 2804, the recording paper 2A is positioned such that the center line thereof in the width direction and the center line of the ink ribbon 8 in the width direction are aligned with reach other irrespective of the dimension of the recording paper 2A in the width direction. Therefore, displacement between the ink ribbon 8 and the recording paper 2A in the width direction can be reduced and the image quality can be improved.

The recording paper 2A is unwound from the recording paper roll 2 by the conveying unit 18 and an image is printed on the recording paper 2A by the ink ribbon 8 and the print head 24. Then, the recording paper 2A on which the image is printed is cut by the cutter device 26 and is ejected onto the paper output tray 13.

As described above, according to the present embodiment, the first recording-paper-roll supporting device 14 has a simple structure in which the cam followers 62 are selectively engaged with the insertion-portion-side cam surfaces 50 and the engaging claws 64 are selectively engaged with the support-shaft-side cam surfaces 54. The flange portion 60 can be positioned relative to the support shaft 40 in the axial direction with such a simple structure.

Since the first recording-paper-roll supporting device 14 has a simple structure, the size of the first recording-paper-roll supporting device 14 can be reduced. As a result, the size of the printer 10 can be reduced.

In addition, a plurality of types of recording paper rolls 2 having different dimensions in the width direction can be easily attached simply by rotating the first member 30 and the second member 32 relative to each other. Since there is no risk that an adjuster or the like will be lost, the user friendliness can be increased.

In addition, according to the present embodiment, the first recording-paper-roll supporting device 14 is disposed at an end of the recording paper roll 2 and the second recording-paper-roll supporting device 15 is disposed at the other end of the recording paper roll 2. Therefore, in the case of replacing the recording paper roll 2 with another recording paper roll 2 having a different width, a necessary adjustment can be performed by operating only the first recording-paper-roll supporting device 14 without operating the second recording-paper-roll supporting device 15. Thus, the operability can be considerably improved.

According to the present embodiment, the first recording-paper-roll supporting device 14 is disposed at an end of the recording paper roll 2 and the second recording-paper-roll supporting device 15 is disposed at the other end of the recording paper roll 2. However, the present invention is not limited to this, and the first recording-paper-roll supporting device 14 may be disposed at either end of the recording paper roll 2.

The present application contains subject matter related to that disclosed in Japanese Priority Patent Application JP 2008-127011 filed in the Japan Patent Office on May 14, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A recording-paper-roll supporting device, comprising:

a first member; and a second member, wherein, (a) the first member includes (i) an insertion portion inserted into a center hole of a recording paper roll at an end of the recording paper roll, the recording paper roll being obtained by winding a sheet of recording paper into a roll, (ii) a supporting portion provided at an end of the insertion portion, and (iii) a support shaft provided at an end of the supporting portion, the supporting portion (1) an outer peripheral surface which is coaxial with the insertion portion,(2) a plurality of insertion-portion-side cam surfaces provided at an end of the outer peripheral surface that is adjacent to the insertion portion, the insertion-portion-side cam surfaces facing the outer peripheral surface in an annular area outside the outer peripheral surface in a radial direction and being disposed at different phases in a circumferential direction and at different heights in an axial direction, (3) a collar portion provided at an end of the outer peripheral surface that is adjacent to the support shaft and having a diameter larger than a diameter of the outer peripheral surface at the end adjacent to the support shaft, (4) a plurality of support-shaft-side cam surfaces provided at an end of the collar portion that is adjacent to the support shaft and being disposed at different phases in the circumferential direction and at different heights in the axial direction, and (5) a cut section formed in an outer peripheral area of the collar portion, (b) the second member includes (i) a cylindrical portion having an inner peripheral surface along which the outer peripheral surface is inserted, (ii) a flange portion provided on the cylindrical portion, the flange portion being coaxial with the cylindrical portion and having a diameter larger than a diameter of the cylindrical portion, (iii) a cam follower provided at an end of the cylindrical portion in the axial direction, the cam follower being selectively engageable with the insertion-portion-side cam surfaces, and (iv) an engaging claw capable of being inserted through the cut section and being moved on the supporting portion, the engaging claw being selectively engageable with the support-shaft-side cam surfaces, and (c) in the state in which the outer peripheral surface is inserted along the inner peripheral surface so that the cylindrical portion is supported by the supporting portion, in which the cam follower is selectively engaged with the insertion-portion-side cam surfaces, and in which the engaging claw is selectively engaged with the support-shaft-side cam surfaces, the engaging claw is elastically deformed in the axial direction by the support-shaft-side cam surface that is engaged with the engaging claw and generates a reactive force which presses the cam follower against the insertion-portion-side cam surface that is engaged with the cam follower, so that the second member is positioned on the supporting portion in the axial direction.

2. The recording-paper-roll supporting device according to claim 1, further comprising an operating knob on the cylindrical portion at a position closer to the engaging claw than the flange portion, the operating knob having a diameter larger than the diameter of the cylindrical portion and smaller than the diameter of the flange portion.

3. The recording-paper-roll supporting device according to claim 1, wherein the support shaft has a spherical surface that projects coaxially with the support shaft at an end of the support shaft.

4. The recording-paper-roll supporting device according to claim 1, wherein the outer peripheral surface of the supporting portion has a click claw which is sectioned by a slit, the click claw having an engaging projection at an end of the click claw, wherein the inner peripheral surface of the cylindrical portion has with an engaging recess engageable with the engaging projection, and wherein, when the cam follower is selectively engaged with the insertion-portion-side cam surfaces and the engaging claw is selectively engaged with the support-shaft-side cam surfaces so that the second member is positioned, the engaging projection engages with the engaging recess, thereby generating a click feeling.

5. A recording-paper-roll supporting device, comprising:

a first member;

a second member; and a coil spring, wherein the first member includes (a) an insertion portion inserted into a center hole of a recording paper roll at an end of the recording paper roll, the recording paper roll being obtained by winding a sheet of recording paper into a roll, and (b) a flange portion provided at an end of the insertion portion, the flange portion being coaxial with the insertion portion and having a diameter larger than a diameter of the insertion portion, wherein the fourth member includes (a) a support shaft, and (b) a plurality of engaging claws provided at an end of the support shaft, the engaging claws being disposed in the insertion portion and engaged with cut sections in the insertion portion while compressing the coil spring, and wherein the support shaft is biased by the coil spring to a projecting position at which the engaging claws engage with the cut sections, and is capable of being pushed inward toward the insertion portion of the support shaft.

6. The recording-paper-roll supporting device according to claim 5, wherein the support shaft has a spherical surface that projects coaxially with the support shaft at an end of the support shaft.

7. A printer comprising:

a recording-paper-roll supporting device including a first member and a second member, wherein, (a) the first member includes (i) an insertion portion inserted into a center hole of a recording paper roll at an end of the recording paper roll, the recording paper roll being obtained by winding a sheet of recording paper into a roll, (ii) a supporting portion provided at an end of the insertion portion, and (iii) a support shaft provided at an end of the supporting portion, the supporting portion including (1) an outer peripheral surface which is coaxial with the insertion portion, (2) a plurality of insertion-portion-side cam surfaces provided at an end of the outer peripheral surface that is adjacent to the insertion portion, the insertion-portion-side cam surfaces facing the outer peripheral surface in an annular area outside the outer peripheral surface in a radial direction and being disposed at different phases in a circumferential direction and at different heights in an axial direction, (3) a collar portion provided at an end of the outer peripheral surface that is adjacent to the support shaft and having a diameter larger than a diameter of the outer peripheral surface at the end adjacent to the support shaft, (4) a plurality of support-shaft-side cam surfaces provided at an end of the collar portion that is adjacent to the support shaft and being disposed at different phases in the circumferential direction and at different heights in the axial direction, and (5) a cut section formed in an outer peripheral area of the collar portion, (b) the second member includes (i) a cylindrical portion having an inner peripheral surface along which the outer peripheral surface is inserted, (ii) a flange portion provided on the cylindrical portion, the flange portion being coaxial with the cylindrical portion and having a diameter larger than a diameter of the cylindrical portion, (iii) a cam follower provided at an end of the cylindrical portion in the axial direction, the cam follower being selectively engageable with the insertion-portion-side cam surfaces, and (iv) an engaging claw capable of being inserted through the cut section and being moved on the supporting portion, the engaging claw being selectively engageable with the support-shaft-side cam surfaces, and (c) in the state in which the outer peripheral surface is inserted along the inner peripheral surface so that the cylindrical portion is supported by the supporting portion, in which the cam follower is selectively engaged with the insertion-portion-side cam surfaces, and in which the engaging claw is selectively engaged with the support-shaft-side cam surfaces, the engaging claw is elastically deformed in the axial direction by the support-shaft-side cam surface that is engaged with the engaging claw and generates a reactive force which presses the cam follower against the insertion-portion-side cam surface that is engaged with the cam follower, so that the second member is positioned on the supporting portion in the axial direction.

8. A printer comprising:

a recording-paper-roll supporting device including a first member, a second member, and a coil spring, wherein the first member includes (a) an insertion portion inserted into a center hole of a recording paper roll at an end of the recording paper roll, the recording paper roll being obtained by winding a sheet of recording paper into a roll, and (b) a flange portion provided at an end of the insertion portion, the flange portion being coaxial with the insertion portion and having a diameter larger than a diameter of the insertion portion, wherein the second member includes (a) a support shaft, and (b) a plurality of engaging claws provided at an end of the support shaft, the engaging claws being disposed in the insertion portion and engaged with cut sections in the insertion portion while compressing the coil spring, and wherein the support shaft is biased by the coil spring to a projecting position at which the engaging claws engage with the cut sections, and is capable of being pushed inward toward the insertion portion of the support shaft.

* * * * *